United States Patent [19]

Miller

[11] Patent Number: 4,734,561

[45] Date of Patent: Mar. 29, 1988

[54] HUMIDIFIER

[76] Inventor: Molly J. Miller, 261 Commonwealth Ave., No. 2, Boston, Mass. 02116

[21] Appl. No.: 822,796

[22] Filed: Jan. 27, 1986

[51] Int. Cl.[4] ..... A61L 9/03

[52] U.S. Cl. ..... 219/275; 219/437; 219/438; 220/8; 220/216

[58] Field of Search ..... 219/271–276, 219/436–438; 220/8, 216; D23/145, 146, 147, 148, 150; 261/120, 142

[56] References Cited

U.S. PATENT DOCUMENTS

| | | | |
|---|---|---|---|
| D. 192,718 | 5/1962 | Madl | D83/1 |
| D. 195,914 | 8/1963 | Luedtke | D62/2 |
| D. 196,086 | 8/1963 | Stolartz | D62/4 |
| D. 297,215 | 6/1985 | Mango et al. | D23/146 |
| 2,403,604 | 7/1946 | Laird | 220/216 |
| 2,426,939 | 9/1947 | Libman et al. | 219/38 |
| 2,580,793 | 1/1952 | Katzman | 299/121 |
| 2,847,734 | 8/1956 | Tauben | 21/119 |
| 2,880,902 | 8/1959 | Owsen | 220/8 |
| 3,130,246 | 4/1964 | Banks | 261/29 |
| 3,420,509 | 1/1969 | Katzman et al. | 261/142 |
| 3,581,529 | 6/1971 | Mitchell | 68/222 |
| 3,637,978 | 1/1972 | Corbett et al. | 219/284 |
| 3,705,415 | 12/1972 | Katzman et al. | 219/271 |
| 3,780,260 | 12/1973 | Elsner | 219/271 |
| 4,624,382 | 11/1986 | Tontarelli | 220/8 |

FOREIGN PATENT DOCUMENTS

| | | | |
|---|---|---|---|
| 0065857 | 5/1980 | Japan | 219/438 |

*Primary Examiner*—A. D. Pellinen
*Assistant Examiner*—Jeffrey A. Gaffin

[57] ABSTRACT

An electric steam humidifier consists of a container defining an operating volume for holding a sufficient amount of water to provide steam for eight hours or more and, disposed within the container, a heating element for heating the water to generate steam. The container includes a base segment defining a portion only of the operating volume, and an upper segment defining another portion of the operating volume and further defining an aperture for escape of steam from the volume. The base segment and the upper segment are joined in a water-tight seal. The upper segment, in a first, operating position, extends vertically away from the base segment, to define with the base segment the operating volume. The humidifier, with the upper segment in a second, storage position relatively closer to the rigid base segment, defines and occupies a significantly reduced volume to facilitate storage and transport.

2 Claims, 8 Drawing Figures

HUMIDIFIER

The invention relates to humidifier devices useful for increasing the level of water vapor in the air for personal comfort and health. Such devices are used in sick rooms to relieve colds, bronchitis and other respiratory ailments, in the home, e.g., in the bedrooms of small children, or in any situation where it is desired to increase the humidity of a room for the comfort of persons in the vicinity.

Humidifiers typically include a large container sized to hold an operating volume of water sufficient for several hours of operation, e.g., about one gallon or more to last through the night, and a heating element for vaporizing the water.

SUMMARY OF THE INVENTION

According to the invention, in an improved humidifier the container comprises a base segment defining a portion only of the operating volume, and an upper segment defining another portion of the operating volume and further defining an aperture for escape of steam from the volume, the base segment and the upper segment joined in a water-tight seal, the upper segment, in a first, operating position, extended vertically away from the base segment, defining with the base segment the operating volume, and the humidifier, with the upper segment in a second, storage position relatively closer to the rigid base segment, defining and occupying a significantly reduced volume to facilitate storage and transport.

In a preferred embodiment, the upper segment is flexible relative to the base, and the container further comprises means for maintaining the upper segment and the base segment in operating volume-defining relationship during use.

These and other features and advantages of the invention will be understood from the following description of a presently preferred embodiment, and from the claims.

PREFERRED EMBODIMENT

We first briefly describe the drawings.

DRAWINGS

Figure 4:
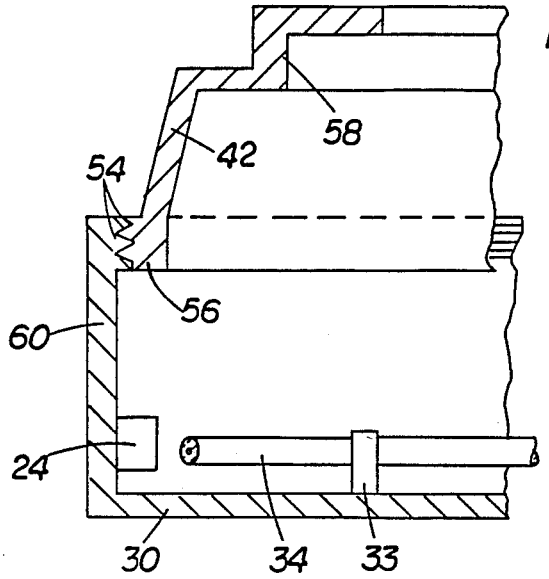
Figure 5:
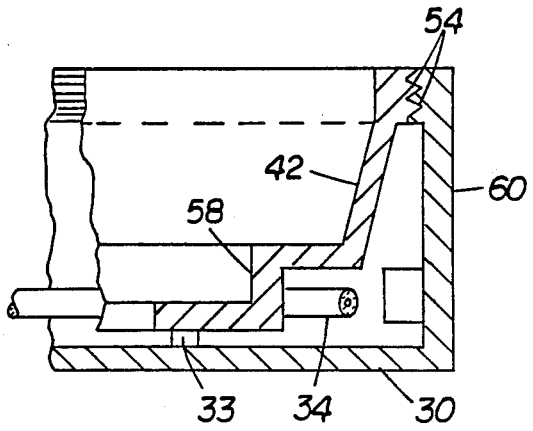
Figure 6:
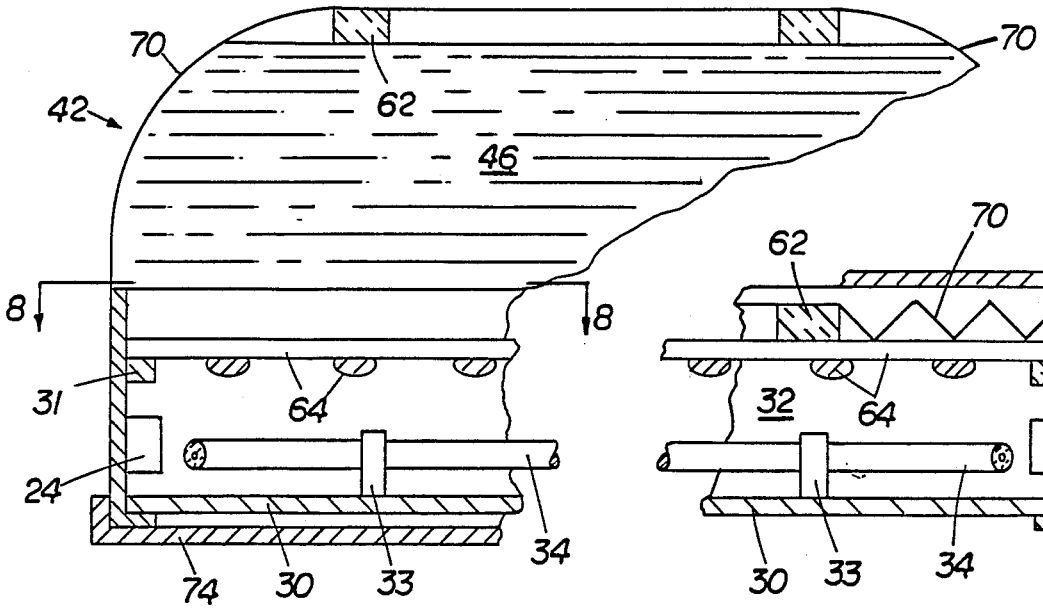
Figure 7:
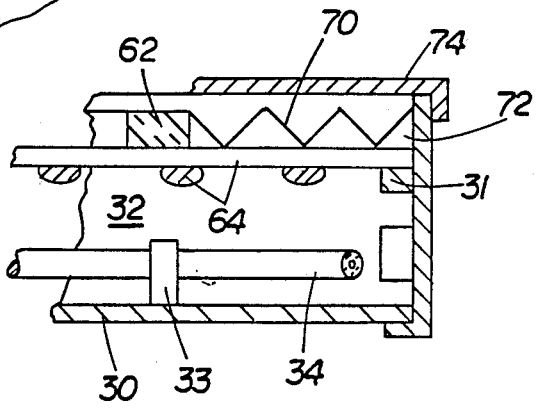
Figure 8:
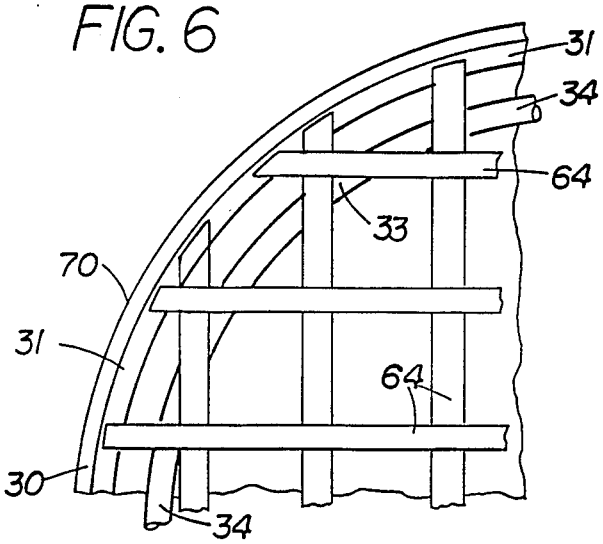

FIGS. 4 and 5, and FIGS. 6 and 7 are similar pairs of views of other embodiments of the invention; and FIG. 8 is a plan view taken at 8—8 of FIG. 6.

Figure 1:
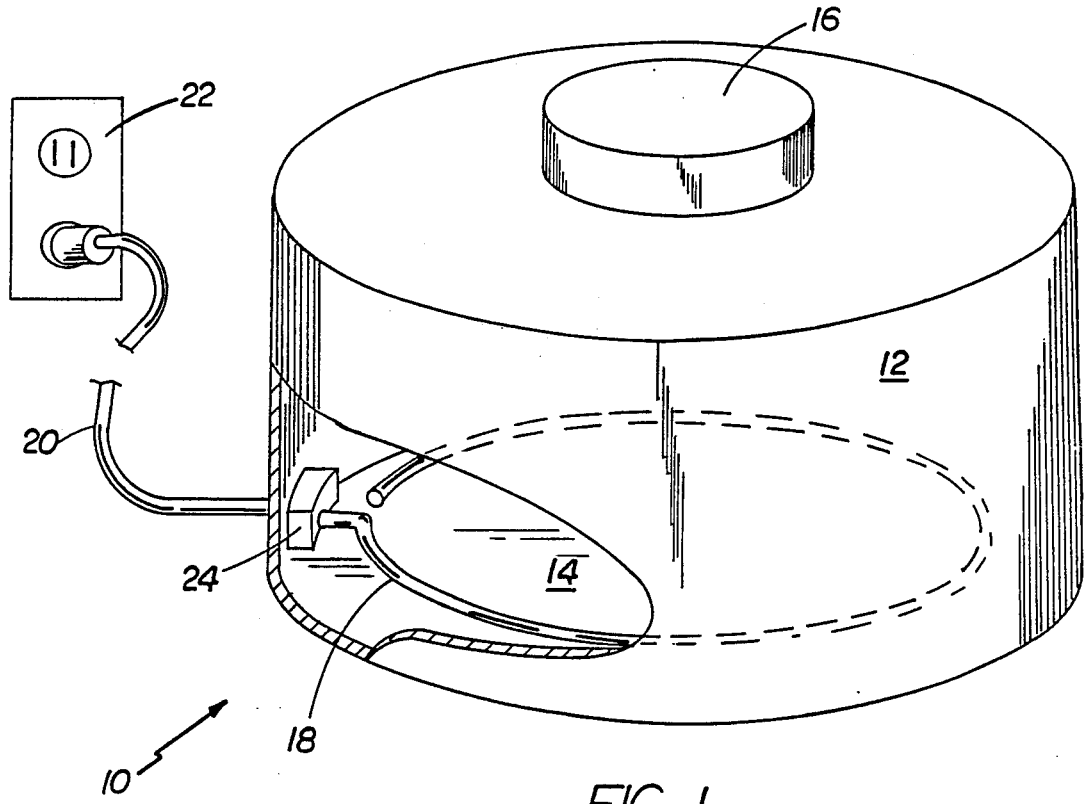
FIG. 1 PRIOR ART
FIG. 1 is a perspective view, partially in section of a prior art humidifier.

Referring to FIG. 1, a prior art humidifier 10 consists of a rigid container 12 of large size, e.g. defining a volume 14 sufficient to hold enough water to generate steam for eight hours, or more. The top of the container defines an aperture 16 for introduction of water into the container, and for escape of steam during use. Within the container, close to the bottom, is disposed a heating coil 18 energized by electricity supplied via plug-and-cord 20 from any available standard wall outlet 22. Many such humidifiers are formed of heat resistant plastic, and also include a sensor 24 for detecting a low water level condition and causing automatic shut-off to prevent the device from overheating.

Figure 2:
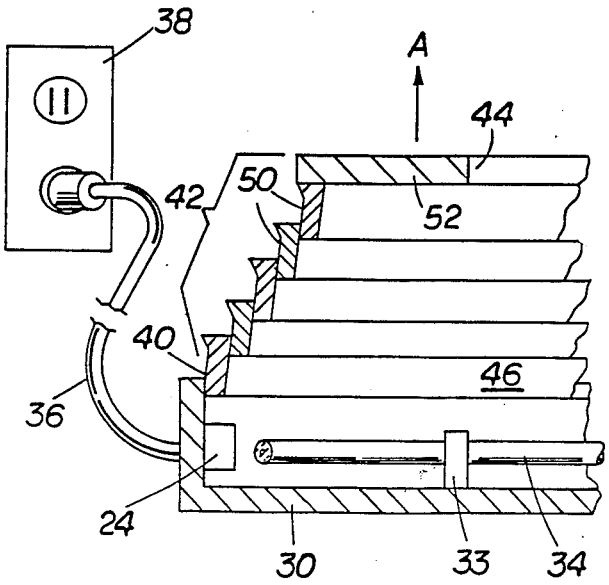
FIGS. 2 and 3 are partial side section views showing one embodiment of the invention in operating and in storage conditions, respectively.

Referring now to FIGS. 2 et seq., there will be described several embodiments of the improved humidifier of the invention. In each embodiment, the humidifier consists of a rigid base segment 30 defining a volume that is substantially less than that required for holding enough water for eight hours operation and, within the rigid base, and generally spaced from and supported thereby, e.g. by brackets 33, an electric heater element 34 powered by electricity received via plug-and-cord 36 from standard wall outlet 38. Affixed to the rigid base via a water-tight joint 40 and disposed thereabove is upper segment 42 which defines aperture 44 for introduction of water into the volume of the humidifier and for allowing escape of water vapor, i.e., steam, during use.

Figure 3:
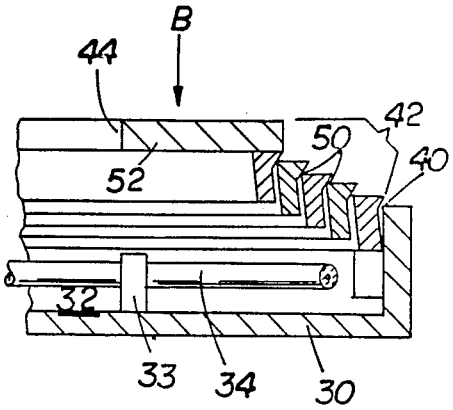

The upper segment, in a first, operating position (FIGS. 2, 4, and 6) extends generally vertically upward, away from the rigid base segment to define, with the base, an operating volume 46 of a size sufficiently large to hold enough water for operation over an extended period, e.g. all night. The upper segment is adapted to be disposed in a second, storage position (FIGS. 3, 5 and 7) relatively closer to the rigid base segment, in which the humidifier, i.e., the base and upper segments, define and occupy a significantly reduced volume, thereby to facilitate storage and transport of the humidifier of the invention.

Turning now to the figures, in one embodiment (FIGS. 2 and 3), the upper segment 42 consists of a set of annular discs 50 sized and adapted, when the inner disc 52 is drawn upward (arrow A), to interengage with peripherally-adjacent surfaces as the set is drawn upward to form water-tight seals, while defining enlarged volume 46. In the second, storage position, achieved by pressing downwardly (arrow B) on the inner disc, the discs are all disposed close to the base, with much less vertical extent.

In the embodiment of FIGS. 4 and 5, concave, relatively rigid upper segment 42 and similarly shaped, rigid base segment 30 are constructed for releasable interengagement, e.g. by means of threads 54, 56. In a first, operating position (FIG. 4), the inner surfaces 58, 60 of upper and lower base segments are disposed in opposition, and the segments are threaded together to form a water-tight container of operating volume 46. In second, storage position (FIG. 5), the upper segment 42 is inverted relative to the base segment 30 and the segments are threaded together to provide a compact, secure package of reduced volume. In the embodiment shown, the upper element is specially shaped to provide space for the heating element 34 in the storage position.

In the embodiment of FIGS. 6 and 7, the upper element 42 is flexible and is held in extended operating position by float member 62 riding on the surface 63 of water within the humidifier. The float has a characteristic buoyancy predetermined to be sufficient to resist spilling when the volume 46 of the humidifier is filled with water. Disposed within the volume of the container, between the flexible upper segment 42 and the heater element 34, engaged upon base lip 31, is an open grid 64 that prevents the flexible member from contact with the heater element as the water level drops. In storage position (FIG. 7), the float member 62 rests on grid 64 and the material 70 of the flexible wall fits compactly into annular space 72 between the float and the upper wall portion of the base segment. In this embodiment a plastic lid 74, stored over the base during operation (FIG. 6), is also provided to tightly seal the device for storage and transport.

Other embodiments of the invention are within the following claims.

What is claimed is:

1. In an electric steam humidifier comprising a container sized defining operating volume holding a sufficient amount of water to provide steam for eight hours or more and, disposed within said container, a heating element heating said water to generate steam, the improvement wherein said container comprises a base segment defining a portion only of said operating volume, and an upper segment defining another portion of said operating volume and further defining an aperture for escape of steam from said volume, said base segment and said upper segment intersecting in a water-tight joint, said upper segment, in a first, operating position, extended vertically upward, away from said base segment, defining with said base segment said operating volume, said upper segment having sidewalls extending generally inwardly from said joint, said aperture for escape of steam having a diameter less than the diameter of said joint, and said upper segment being a flexible segment relative to said base, and said container further comprising float means for riding the surface of water in said container to maintain said flexible segment in extended operating volume-defining relationship during use, said humidifier, with said upper segment in a second, storage position relatively closer to said rigid base segment, defining an occupying a significantly reduced volume to facilitate storage and transport.

2. In an electric steam humidifier comprising a container sized defining operating volume holding a sufficient amount of water to provide steam for eight hours or more and, disposed within said container, a heating element heating said water to generate steam, the improvement wherein said container comprises a base segment defining a portion only of said operating volume, and an upper segment defining another portion of said operating volume and further defining an aperture for escape of steam from said volume, said base segment and said upper segment intersecting in a water-tight joint, said upper segment, in a first, operating position, extended vertically upward, away from said base segment, defining with said base segment said operating volume, said upper segment having sidewalls extending generally inwardly from said joint, said aperture for escape of steam having a diameter less than the diameter of said joint, and said upper segment comprising a concave, rigid segment and said base segment being constructed to release from said upper segment, said upper and base segments in a first operating position, with the concavity of said upper segment facing said base segment, forming a water-tight container, and in a second storage position, with said upper segment inverted from said operating position relative to said base segment, forming a unit for compact storage, said humidifier, with said upper segment in a second, storage position relatively closer to said rigid base segment, defining and occupying a significantly reduced volume to facilitate storage and transport.

* * * * *